US006557779B2

(12) United States Patent
Perr et al.

(10) Patent No.: US 6,557,779 B2
(45) Date of Patent: May 6, 2003

(54) VARIABLE SPRAY HOLE FUEL INJECTOR WITH DUAL ACTUATORS

(75) Inventors: Julius P. Perr, Columbus, IN (US); J. Victor Perr, Greenwood, IN (US); Lester L. Peters, Columbus, IN (US); Donald J. Benson, Columbus, IN (US); John T. Carroll, III, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 39 days.

(21) Appl. No.: 09/796,823

(22) Filed: Mar. 2, 2001

(65) Prior Publication Data

US 2002/0125339 A1 Sep. 12, 2002

(51) Int. Cl.[7] ..... F02M 41/16

(52) U.S. Cl. ..... 239/96; 239/88; 239/124; 239/533.4; 239/533.9; 239/585.1; 123/468; 123/472

(58) Field of Search ..... 239/88, 96, 124, 239/127, 533.2, 533.3, 533.4, 533.9, 533.12, 585.1; 123/445, 446, 447, 456, 468, 472, 506

(56) References Cited

U.S. PATENT DOCUMENTS

| | | | | |
|---|---|---|---|---|
| 3,339,848 A | | 9/1967 | Geiger | |
| 4,151,958 A | | 5/1979 | Hofmann | |
| 4,187,825 A | | 2/1980 | Loyd, Jr. | |
| 4,202,500 A | | 5/1980 | Keiczek | |
| 4,215,821 A | | 8/1980 | Eblen | |
| 4,285,471 A | | 8/1981 | Eblen et al. | |
| 4,382,554 A | | 5/1983 | Hofmann | |
| 4,546,739 A | | 10/1985 | Nakajima et al. | |
| 4,570,853 A | * | 2/1986 | Schmied | 239/533.3 |
| 4,984,738 A | | 1/1991 | Winquist | |
| 5,199,398 A | | 4/1993 | Nylund | |
| 5,458,292 A | | 10/1995 | Hapeman | |
| 5,463,996 A | | 11/1995 | Maley et al. | |
| 5,647,536 A | | 7/1997 | Yen et al. | |
| 5,676,114 A | | 10/1997 | Tarr et al. | |
| 5,860,597 A | | 1/1999 | Tarr | |
| 5,884,611 A | | 3/1999 | Tarr et al. | |
| 5,899,389 A | | 5/1999 | Pataki et al. | |
| 6,220,528 B1 | * | 4/2001 | Cooke et al. | 239/533.3 |
| 6,340,121 B1 | * | 1/2002 | Lambert | 239/533.4 |
| 6,378,503 B1 | * | 4/2002 | Lambert | 239/533.12 |

FOREIGN PATENT DOCUMENTS

| | | |
|---|---|---|
| GB | 2 266 559 | 11/1993 |
| JP | 4-140468 | 5/1992 |

* cited by examiner

*Primary Examiner*—Steven J. Ganey
(74) *Attorney, Agent, or Firm*—Nixon Peabody LLP; Tim L. Brackett, Jr.

(57) ABSTRACT

An improved closed nozzle injector assembly for injecting high pressure fuel into the combustion chamber of an engine is provided which includes a first needle valve element associated with a first set of injector orifices, a first needle valve control device for controlling the opening and closing of the first needle valve, a second needle valve associated with a second set of injector orifices and a second needle valve control device for controlling the opening and closing of the second needle valve. Each needle valve control device includes a control volume positioned at one end of the respective needle valve, a control volume charge circuit for supplying high pressure fuel to the respective control volume and the respective injection control valve for controlling the flow of high pressure fuel from the respective control volume to a low pressure drain thereby controlling the movement of the respective needle valve. Using a dedicated control volume and injection control valve for each needle valve element permits effective control over the duration of pilot and post fuel injection events while also providing variable rate shaping capability for optimized emissions and fuel economy. The present dual needle valve element injector includes various components such as biasing springs which are positioned and interconnected to other components in a manner which creates a simple, compact fuel injector package providing independent control of two sets of spray orifices in one injector.

20 Claims, 5 Drawing Sheets

VARIABLE SPRAY HOLE FUEL INJECTOR WITH DUAL ACTUATORS

TECHNICAL FIELD

This invention relates to an improved fuel injector which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. A commonly used injector is a closed-needle injector which includes a needle assembly having a spring-biased needle valve element positioned adjacent the needle orifices for resisting blow back of exhaust gas into the pumping or metering chamber of the injector while allowing fuel to be injected into the cylinder. The needle valve element also functions to provide a deliberate, abrupt end to fuel injection thereby preventing a secondary injection which causes unburned hydrocarbons in the exhaust. The needle valve is positioned in a needle cavity and biased by a needle spring to block fuel flow through the needle orifices. In many fuel systems, when the pressure of the fuel within the needle cavity exceeds the biasing force of the needle spring, the needle valve element moves outwardly to allow fuel to pass through the needle orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed needle fuel injector systems. One method of controlling the initial rate of fuel injection is to spill a portion of the fuel to be injected during the injection event. For example, U.S. Pat. No. 5,647,536 to Yen et al. discloses a closed needle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the needle cavity. However, the needle valve is not servo-controlled and, thus, this needle assembly does not include a control volume for controlling the opening and closing of the needle valve. Moreover, the rate shaping needle assembly does not permit the rate to be selectively varied.

Other rate shaping systems decrease rate of fuel flow during the initial portion of the injection event by, for example, throttling the fuel to the needle orifices. Although these systems create injection rate shaping, the spilling and throttling of fuel during the initial period of injection achieves a reduced injection flow rate by reducing the injection pressure adjacent the needle orifices. The decrease in injection pressure may disadvantageously result in decreased atomization of the fuel spray by the needle orifices, thus adversely affecting fuel economy and increasing emissions.

Another manner of optimizing combustion is to create pilot and/or post injection events. Most current diesel injectors include fixed needle orifice areas sized to provide optimum injection duration at rated speed and load with the highest allowable injection pressure. However, in order to optimize combustion, pilot and post injection events must include extremely small quantities of fuel at high injection pressures. With a fixed spray orifice size, this results in an extremely short event that is difficult to control. To compensate, the needle opening velocity may be reduced so that the fuel flow is throttled before the spray orifices during the pilot and post injection events. However, needle velocity is not easily controllable from injector to injector, while throttling wastes fuel energy and does not provide optimum combustion performance. At low speed and light load, it is also desirable to have small spray orifices to increase injection duration without lowering injection pressure.

Another fuel injector design providing some limited control over fuel injection rate and quantity includes two needle valve elements for controlling the flow of fuel through respective sets of injection orifices. For example, U.S. Pat. No. 5,458,292 to Hapeman discloses a fuel injector with inner and outer injector needle valves biased to close respective sets of spray holes and operable to open at different fuel pressures. The inner needle valve is reciprocally mounted in a central bore formed in the outer needle valve. However, the opening of each needle valve is controlled solely by injection fuel pressure acting on the needle valve in the opening direction such that the valves necessarily open when the injection fuel pressure reaches a predetermined level. Consequently, the overall and relative timing of opening of the valves, and the rate of opening of the valves, cannot be controlled independently. Moreover, the valve opening timing and rate is undesirably dependent on the injection fuel pressure.

U.K. Pat. Application No. 2266559 to Hlousek discloses a closed needle injector assembly including a hollow needle valve for cooperating with one valve seat formed on an injector body to provide a ma in injection through all the injector orifices and an inner valve needle reciprocally mounted in the hollow needle for creating a pre-injection through a few of the injector orifices. However, the valve seat allowing the inner valve needle to block the pre-injection flow is formed on the hollow valve member and the inner valve needle is biased outwardly away from the injector orifices. This arrangement requires a third valve seat for cooperation with the inner valve element when in a pre-injection open position to prevent flow through all of the injector orifices, resulting in an unnecessarily complex and expensive assembly. Also, this assembly is designed for use with two different sources of fuel requiring additional delivery passages in the injector. In addition, like Hapeman, this design requires the timing and rate of opening of at least one of the needle valves to be controlled by fuel injection pressure thereby limiting injection control.

U.S. Pat. No. 5,199,398 to Nylund discloses a fuel injection valve arrangement for injecting two different types of fuels into an engine which includes inner and outer poppet type needle valves. During each injection event, the inner needle valve opens a first set of orifices to provide a preinjection and the outer needle valve opens a second set of orifices to provide a subsequent main injection. The outer poppet valve is a cylindrical sleeve positioned around a stationary valve housing containing the inner poppet valve.

U.S. Pat. No. 5,899,389 to Pataki et al. discloses a fuel injector assembly including two biased valve elements controlling respective orifices for sequential operation during an injection event. A single control volume may be provided at the outer ends of the elements for receiving biasing fluid to create biasing forces on the elements for opposing the fuel pressure opening forces. However, only one control volume is used thereby preventing independent selective control of the elements.

Although some systems discussed hereinabove create different stages of injection, further improvement is desirable. Therefore, there is need for a servo-controlled fuel injector for providing enhanced selective control over injection timing and duration and variable control of injection rate shaping.

SUMMARY OF THE INVENTION

It is an object of the present invention, therefore, to overcome the disadvantages of the prior art and to provide a fuel injector which is capable of effectively and predictably controlling the rate of fuel injection.

It is another object of the present invention to provide a servo-controlled injector capable of effectively controlling the flow rate of fuel injected during each injection event so as to minimize emissions.

It is another object of the present invention to provide a servo-controlled injector assembly capable of shaping the rate of fuel injection which is also simple and inexpensive to manufacture.

It is yet another object of the present invention to provide an injector capable of effectively slowing down the rate of fuel injection during the initial portion of an injection event while subsequently increasing the rate of injection to rapidly achieve a high injection rate.

It is a further object of the present invention to provide an injector for use in a variety of fuel systems, including common rail system, accumulator pump systems and pump-line-needle fuel systems, which effectively controls the rate of injection at each cylinder location.

Still another object of the present invention is to provide a rate shaping injector which is capable of selectively creating numerous injection rate shapes to optimize emissions and fuel economy.

Yet another object of the present invention is to provide an injector which offers maximum flexibility in controlling fuel injection quantities during pilot and post injections while permitting injection rate shaping.

Another object of the present invention is to provide an injector which relaxes the need for a fast event, single actuator.

These and other objects of the present invention are achieved by providing a closed nozzle injector assembly for injecting fuel at high pressure into the combustion chamber of an engine, comprising an injector body containing an injector cavity and a plurality of injector orifices communicating with one end of the injector cavity to discharge fuel into the combustion chamber wherein the plurality of injector orifices include a first set of orifices and a second set of orifices and the injector body includes a fuel transfer circuit for transferring supply fuel to the plurality of injector orifices. The injector also includes a first needle valve element positioned in the injector cavity for controlling fuel flow through a first set of injector orifices and a first valve seat formed on the injector body. A first needle valve element is movable from a closed position against the first valve seat blocking flow through the first set of injector orifices to an open position permitting flow through the first set of injector orifices. A second needle valve element is also provided and positioned in the injector cavity for controlling fuel flow through the second set of injector orifices, and a second valve seat is provided and formed on the injector body. The second valve element is movable from a closed position against the second valve seat blocking flow through the second set of injector orifices to an open position permitting flow through the second set of injector orifices. A first control volume is positioned adjacent an outer end of the first needle valve element while a first control volume charge circuit is used to supply fuel from the fuel transfer circuit to a first control volume. A first drain circuit is provided for draining fuel from the first control volume to a low pressure drain while a first injection control valve is positioned along a first drain circuit for controlling the flow of fuel through the first drain circuit to control movement of the first needle valve element between the opened and closed positions. A second control volume is also provided and positioned adjacent an outer end of the second needle valve element while a second control volume charge circuit supplies fuel from the fuel transfer circuit to the second control volume. Likewise, a second drain circuit is provided for draining fuel from the second control volume to a low pressure drain while a second injection control valve is positioned along the second drain circuit for controlling the flow of fuel through the second drain circuit to control movement of the second needle valve element between the opened and closed positions.

The second needle valve element may be telescopingly received within a cavity formed in the first needle valve element to form a sliding fit with an inner surface of the first needle valve element. The first and second injection control valves may each include an actuator and a reciprocally mounted, selectively movable control valve member. The actuator may include a solenoid assembly. The injector may further include a first biasing spring for biasing the first needle valve element toward a closed position and a second biasing spring for biasing the second needle valve element toward the closed position wherein both the first and second needle valve elements extend through inner radial extents of both the first and second biasing springs. The first and: second biasing springs may be positioned in nonoverlapping serial relationship along a longitudinal axis. The injector may further include a second spring seat assembly for abutment by the second biasing spring including a transverse extension engaging the second needle valve element and extending from the second needle valve element through an aperture formed in the first needle valve element. The aperture may be elongated in shape and the second spring seat assembly may further include an annular seat connected to the transverse extension for abutment by the second biasing spring. The actuators for the first and second needle valve elements may be positioned adjacent one another in side-by-side relationship with respective axes of reciprocation of the control valve members positioned in parallel. The first control volume may be positioned along a longitudinal axis of the injector body between the injector orifices and the second control volume. Also, the first control volume may be positioned along a longitudinal axis of the injector body between the second control volume and the first and second biasing spring.

DETAILED DESCRIPTION OF THE PREFERRED EMBODIMENT

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer the portions of the injector assembly which are, respectively, farthest away and closest to the engine cylinder when the injector is operatively mounted on the engine.

Figure 1:
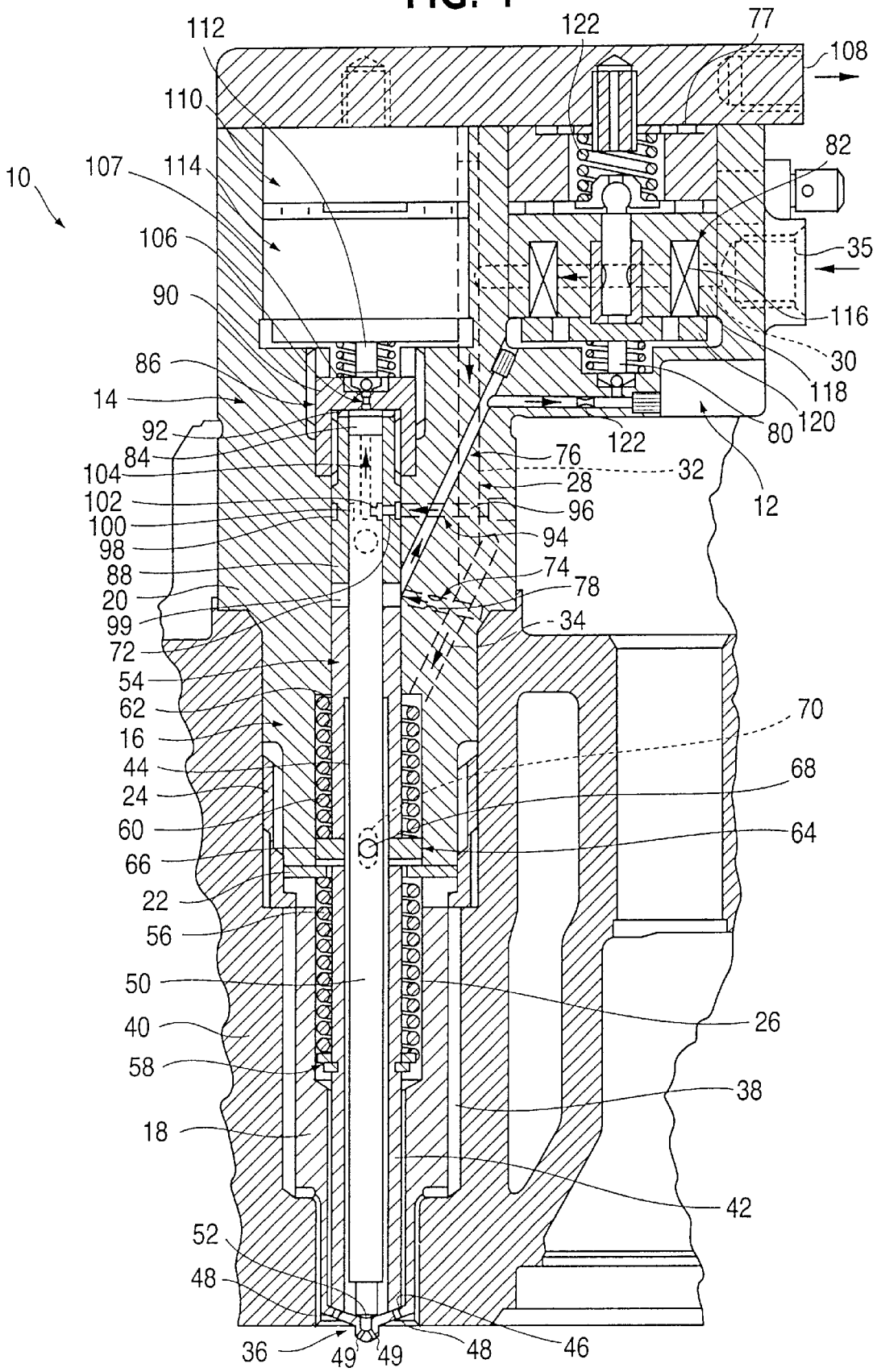
FIG. 1 is an enlarged cross sectional view of the closed nozzle injector of the present invention.

Referring to FIG. 1, there is shown a closed needle injector, indicated generally at 10, incorporating needle valve control devices 12 and 14 of the present invention. Closed needle injector 10 generally includes an injector body 16 formed from a lower needle housing 18, an upper barrel 20, a spacer 22 and a retainer 24 for holding housing 18, spacer 22 and barrel 20 in compressive abutting relationship. For example, the outer end of retainer 24 may contain internal threads for engaging corresponding external threads on barrel 20 to permit the entire injector body 16 to be held together by simple relative rotation of retainer 24 with respect to barrel 20.

Injector body 16 includes an injector cavity, indicated generally at 26, formed in needle housing 18 and upper barrel 20. Injector body 16 further includes a fuel transfer circuit 28 comprised of delivery passages 30, 32 and 34 formed in upper barrel 20 for delivering fuel from a high pressure source to injector cavity 26 via a fuel supply inlet 35. Injector body 16 also includes a plurality of injector orifices 36 fluidically connecting injector cavity 26 with a combustion chamber of an engine (not shown). Injector 10 is positioned in a receiving bore 38 formed in, for example, the engine block 40 of an internal combustion engine.

The closed needle injector 10 of the present invention can be adapted for use with a variety of fuel systems. For example, closed needle injector 10 may receive high pressure fuel from a high pressure common rail or alternatively, a dedicated pump assembly, such as in a pump-line-nozzle system or a unit injector system incorporating, for example, a mechanically actuated plunger into the injector body. The injection rate shaping needle assembly of the present invention may also be incorporated into the fuel injectors and fuel system disclosed in U.S. Pat. No. 5,676,114 entitled Needle Controlled Fuel System With Cyclic Pressure Generation, the entire contents of which is hereby incorporated by reference. Thus, closed needle injector assembly 10 of the present invention may be incorporated into any fuel injection system which supplies high pressure fuel to fuel transfer circuit 28 while permitting needle valve control devices 12 and 14 to control the timing, quantity and rate shape of the fuel injected into the combustion chamber.

Closed nozzle fuel injector 10 also includes an outer needle valve element 42 positioned in injector cavity 26 and having a generally cylindrical shape forming an inner cavity 44. An outer valve seat 46 is formed at the lower end of needle housing 18 for abutment by the lower end of outer needle valve element 42 when in a closed position. Injector orifices 36 include an outer set of orifices 48 and an inner set of injector orifices 49. Outer valve seat 46 is formed adjacent outer set of injector orifices 48 so as to prevent fuel flow from injector cavity 26 through outer set of injector orifices 48 when outer needle valve element 42 is in the closed position as shown in FIG. 1. Closed nozzle fuel injector 10 also includes an inner needle valve element 50 reciprocally mounted in inner cavity 44 of outer needle valve element 42, and an inner valve seat 52 formed on the inner surface of lower needle housing 18 upstream of the inner set of injector orifices 49. When inner needle valve element 50 is in the closed position as shown in FIG. 1, the lower end of needle valve element 50 abuts inner valve seat 52 so as to prevent fuel flow from injector cavity 26 into the inner set of injector orifices 49. The upper end of outer needle valve element 42 at 54 is sized to form a close sliding fit with the inner surface of upper barrel 20 forming injector cavity 26 so as to create a fluid seal. Likewise, a portion of inner needle valve element 50 at 54 is sized to form a close sliding fit with the inner surface of outer needle valve element 42 forming inner cavity 44 so as to create a fluid seal.

Closed nozzle injector assembly 10 also includes an outer biasing spring 56, i.e. coil spring, positioned within a lower portion of injector cavity 26 for biasing outer needle valve element 42 into the closed position as shown in FIG. 1. The lower end of outer biasing spring 56 engages a seat assembly 58 fixedly secured to outer needle valve element 42. The upper end of outer biasing spring 56 is seated against a radial extension of spacer 22. Closed nozzle injector assembly 10 also includes an inner biasing spring 60, i.e. coil spring, positioned above outer seated against an integral land 62 formed in upper barrel 20. The lower end of inner biasing spring 60 engages a spring seat assembly 64 for biasing inner needle valve element 50 into the closed position as shown in FIG. 1. Specifically, spring seat assembly 64 includes an annular seating ring 66 secured to inner needle valve element 50 via a transverse extension or pin 68 connected to inner needle valve element 50 and extending radially to securely engage annular seating ring 66. Pin 68 is securely connected to inner needle valve element 50 but extends through an elongated slot or aperture 70 formed in outer needle valve element 42 to allow relative movement of outer needle valve element 42 relative to inner needle valve element 50 without exerting any force on outer needle valve element 42. The details of spring seat assembly 64 are also shown in a different view in the embodiment of FIG. 2.

First or outer needle control device 12 includes a control volume or cavity 72 formed in injector cavity 26 adjacent the upper end of outer needle valve element 42 and a control volume charge circuit 74 for directing fuel from fuel transfer circuit 28 into control volume 72. First needle valve control device 12 also includes a drain circuit 76 formed partially in barrel 20 for draining fuel from control volume 72 and an injection control valve 77 positioned along drain circuit 76 for controlling the flow of fuel through drain circuit 76 so as to cause controlled, predetermined movement of outer needle valve element 42. Control volume charge circuit 74 includes an orifice 78. As shown in FIG. 1, injection control valve 77 includes a control valve member 80 and an actuator assembly 82 for selectively moving control valve member 80 so as to precisely control the movement of outer needle valve element 42.

Second needle valve control device 14 includes a control volume or cavity 84 formed within a valve element guide assembly 86 securely connected to barrel 20. Valve element guide assembly 86 may include a lower section 88 for receiving the upper end of inner needle valve element 50 and an upper section 90 threadably mounted on the upper end of lower section 88. Upper section 90 may then threadably engage barrel 20 to secure the assembly in place. A seal 92 is positioned between the upper end of lower section 88 and upper section 90 to fluidically seal control volume 84 at the interface of the two sections. A control volume charge circuit 94 is provided for directing fuel from fuel transfer circuit 28 into control volume 84. Control volume charge circuit 94 includes a transverse passage 96 extending from fuel transfer circuit 28 through barrel 20 to communicate with an outer annular groove 98 formed in lower section 88 of valve element guide assembly 86. A radial passage 99 extends from outer annular groove 98 through lower section 88 to communicate with an outer annular groove 100 formed in the upper portion of inner needle valve element 50. A radial passage 102 extends radially inwardly from outer annular groove 100 to connect with an axial passage 104 which opens at an opposite end into control volume 84. Second needle valve control device 14 also includes a drain circuit 106 extending through upper section 90 of valve element guide assembly 86 and further including other passages (not shown) formed in injector body 16 for draining fuel from control volume 84 to a drain outlet 108 and onward to a low pressure drain. Second needle valve control device 14 also includes an injection control valve 110 including a control valve member 112 and an actuator assembly 114 to enable precise control over the movement of inner needle valve element 50 so as to predictably control the flow of fuel through inner injector orifices 49. It should be noted that drain outlet 108 receives drain fuel from both drain circuits 76 and 106.

Injection control valves 77 and 110 are positioned in side-by-side relationship in the upper portion of barrel 20 and may contain the same type, or different types, of actuator assemblies. Actuator assemblies 82, 114 may be any type of actuator assembly capable of selectively controlling the movement of respective control valve members 80, 112 with a sufficient degree of responsiveness. For example, an electromagnetic, magnetorestrictive or piezoelectric type actuator may be used. As shown in FIG. 1, in the electromagnetic embodiment, actuator assembly 82 includes a coil 116 mounted around a stator 118 and positioned adjacent a movable armature 120. Control valve member 80 is biased into the closed position by spring 122 thereby blocking fuel flow through drain circuit 76. Upon actuation, armature 120 is attracted to stator 118 thereby moving armature 120 upwardly as shown in FIG. 1 causing the opening of control valve member 80. Injection control valve 110 includes similar structure and functions in a similar manner. Preferably, injection control valves 77 and 110 are of the two-way, solenoid-operated type.

During operation, prior to an injection event, injection control valve 77 and 110 are both de-energized and inner and outer needle valve elements 50 and 42, respectively, are biased into the closed position against inner valve seat 52 and outer valve seat 46, respectively, by inner biasing spring 60 and outer biasing spring 56. In addition, the fuel pressure in control volumes 84 and 72 is at the same high pressure level as the fuel in fuel transfer circuit 28 and thus at the same level as the injection fuel in the lower portion of injector cavity 26 surrounding outer needle valve element 42 and the injection fuel pressure in the lower portion of inner cavity 44 adjacent the lower end of inner needle valve element 50. Thus fuel pressure forces acting on the upper ends of needle valve elements 42 and 50 also bias the valve elements into the closed position blocking flow through the respective injector orifices. At a predetermined time, for example, during engine operation, one or both of the actuator assemblies 82 and 114 are energized to move the respective control valve member into the open position causing high pressure fuel to flow from the respective control volume 84, 72 through the respective drain circuit 106, 76 to the low pressure drain. Simultaneously, high pressure fuel flows from fuel transfer circuit 28 through, for example, control volume charge circuit 94, orifice 102 and axial passage 104 into control volume 84. However, orifice 102 is designed with a cross sectional flow area to produce the required pressure decrease in control volume 84 in conjunction with the drain orifice 107. As a result, the pressure in control volume 84 immediately decreases. Fuel pressure forces acting on inner needle valve element 50 due to the high pressure fuel in the lower portion of inner cavity 44, begin to move inner needle valve element 50 outwardly against the bias force of inner biasing spring 60. It should be noted that as inner needle valve element 50 moves upwardly as shown in FIG. 1, outer annular groove 100 is designed to continually communicate with radial passage 99 connected to outer annular groove 98. Likewise, a similar operation occurs when actuator assembly 82 is energized to cause high pressure fuel to drain from control volume 72 through drain circuit 76. Similarly, orifice 78 is designed with a cross sectional flow area to produce the required pressure decrease in control volume 72 in conjunction with the drain orifice 122 positioned in drain circuit 76. The decrease in fuel pressure in control volume 72 permits high pressure forces acting on outer needle valve element 42 due to high pressure fuel in inner cavity 44 to move outer needle valve element 42 upwardly causing fuel to flow through orifices 48.

During the operation and control of one or both of first needle valve control device 12 and second needle valve control device 14, at the end of an injection event, the respective injection control valve is de-energized and the respective control valve member moved into a closed position blocking flow through the respective drain circuit. As a result, fuel pressure in the respective control volume immediately increases as high pressure fuel flows into the control volume via the respective control volume charge circuit. Consequently, the high pressure fuel present in the control volume acts on the respective needle valve element to create fuel pressure forces which in combination with the bias force of the respective spring overcome the fuel pressure forces acting on the respective needle valve element in the opposite direction, thereby closing the respective needle valve element and terminating injection.

Figure 2:
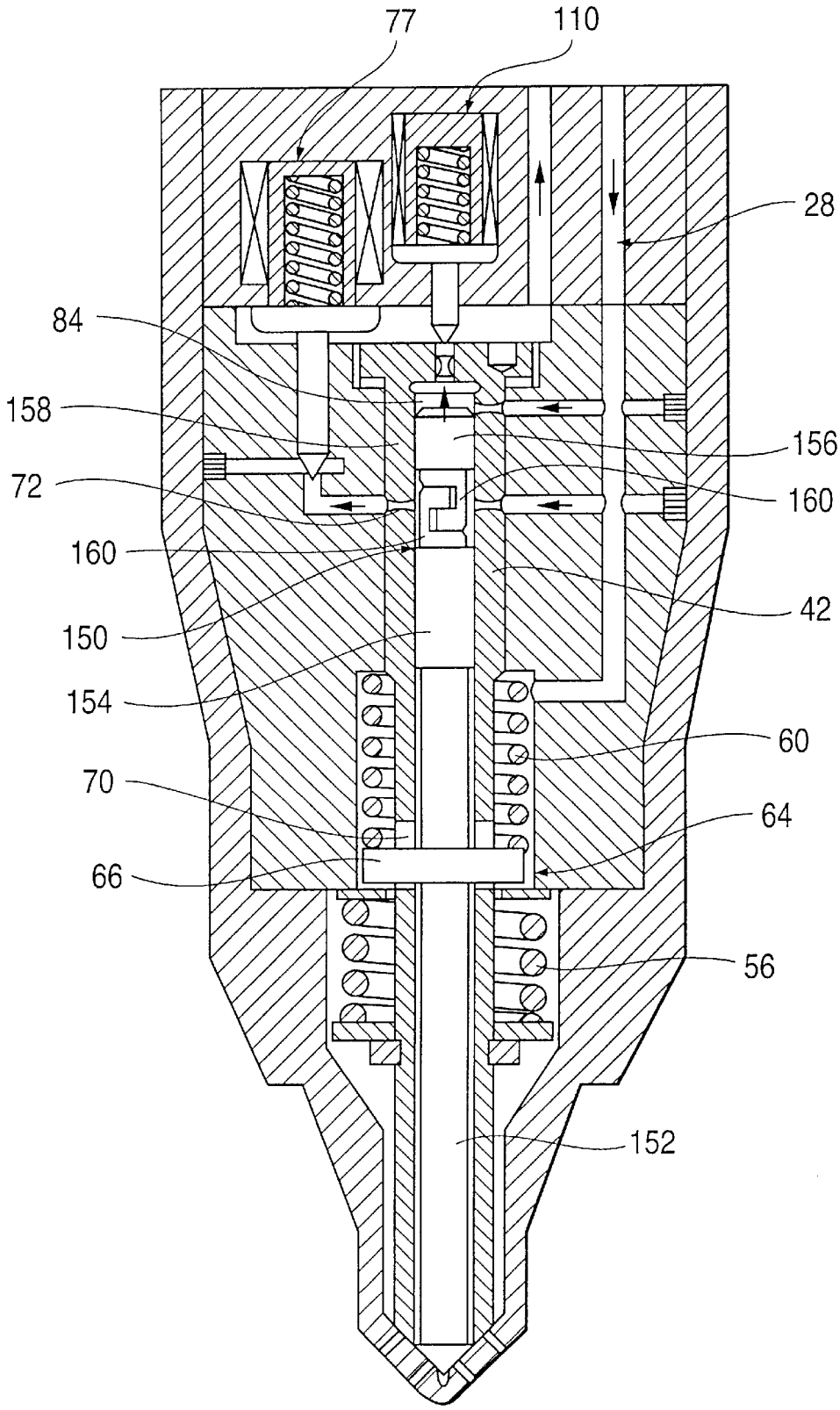
FIG. 2 is an enlarged cross sectional view of a portion of a closed nozzle injector in accordance with a second embodiment of the present invention.
Figure 3C:
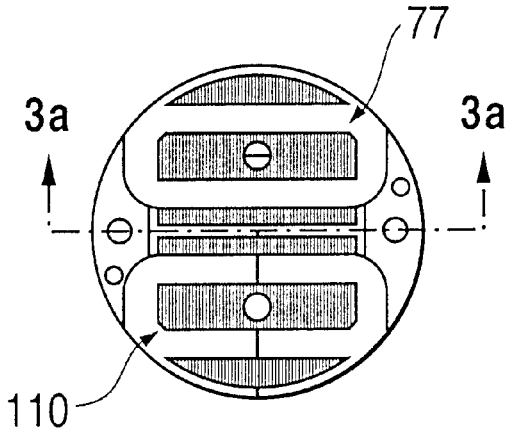
FIGS. 3*a*–3*d* are various cross sectional views of an alternative embodiment of the present invention.
Figure 3D:
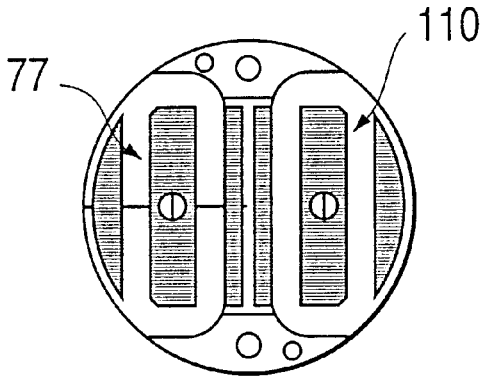
Figure 3A:
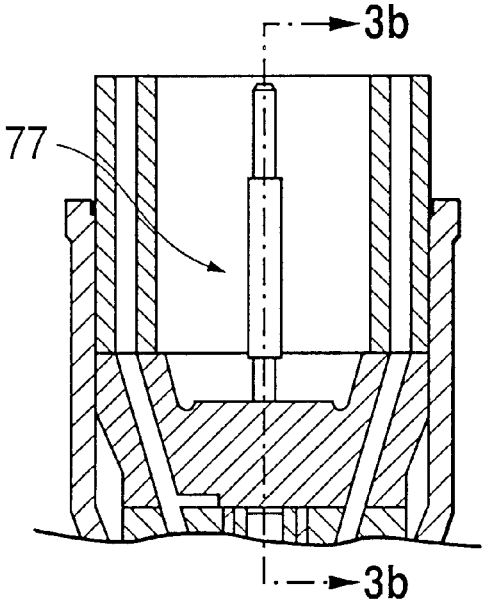
Figure 3B:
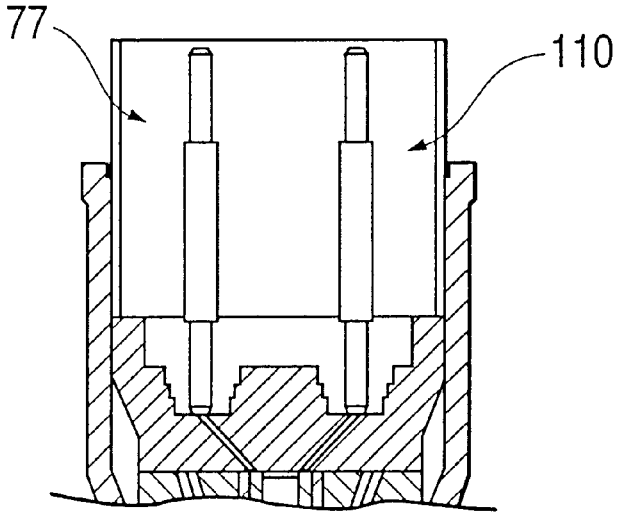

Referring to FIG. 2, the second embodiment of the closed nozzle fuel injector assembly of the present invention is illustrated which is, in many respects, the same as the embodiment of FIG. 1 except that the inner needle valve element is formed as two separate pieces and connected using an articulated coupling 150. Components which are the same or substantially similar to those disclosed in the embodiment of FIG. 1 will be referred to with the same reference numerals. In the embodiment of FIG. 1, it should be noted that the outer needle valve element 42 and the lower section 88 of valve element guide 86 must be concentric and fitted to a common inner needle valve element diameter. In the embodiment of FIG. 1, this requirement is accomplished by making the lower guide section 88 and outer needle valve element 42 from a single piece of stock through outer diameter and inner diameter grinding operations and then splitting the cylindrical ground stock into two pieces with a premachined notch. The embodiment of FIG. 2 represents another approach. Specifically, inner needle valve element 152 may be formed as two pieces including a lower needle section 154 and an upper needle section 156. Articulated coupling 150 may then be used to connect lower needle section 154 and upper needle section 156 to create a secure axial connection while permitting the two sections to be positioned in a nonconcentric manner. Upper needle section 156 is designed with an outer diameter to match the inner diameter of a guide 158 while lower needle section 154 is designed to form a close sliding fit with the inner diameter of outer needle valve element 42. In this manner, guide 158 may be formed as a separate piece from outer needle valve element 42. Although the axis of the bore formed in guide 158 may not axially aligned with the bore formed in outer needle valve element 42, this nonconcentricity does not adversely affect the reciprocal movement of inner needle valve element 152 due to the compensating affect of articulated coupling 150. As shown, articulated coupling 150 includes two C-shaped extensions 160 formed on opposing ends of lower needle section 154 and upper needle section 156. The C-shaped legs 160 are designed to minimize axial play, if any, while permitting slight relative transverse movement between the sections. Any other connection which achieves the function of compensating for nonconcentricity between the bores while creating a secure connection may alternatively be used.

FIGS. 3*a*–3*d* represent yet another embodiment of the present invention wherein injection control valves 77 and 110 are sized and positioned in the injector to fit within conventional packaging constraints of the injector body.

Figure 4B:
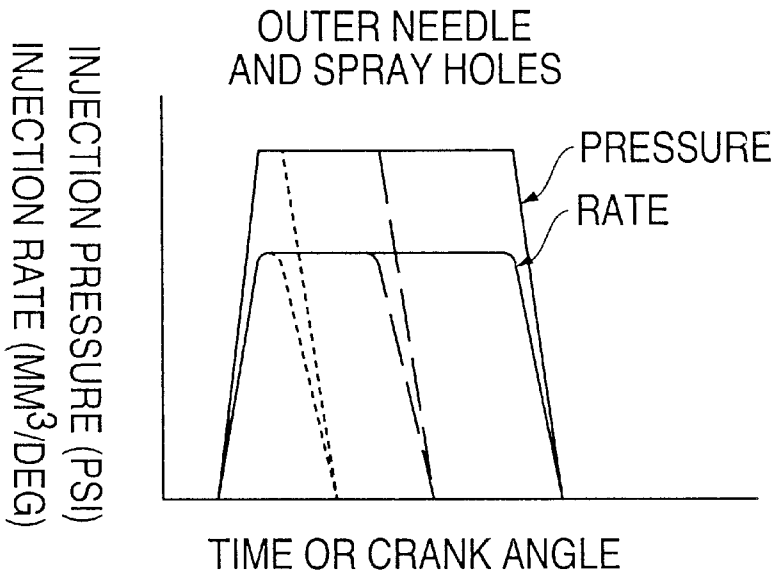
FIGS. 4*a* and 4*b* are graphs showing injection rate changes of the injectors of FIGS. 1 and 2 at a fixed injection pressure and different injection duration.
Figure 4A:
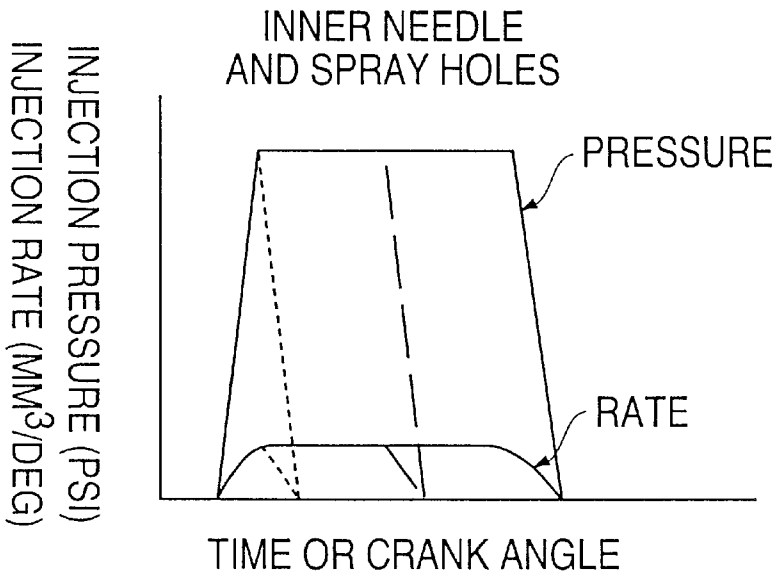
Figure 4A:
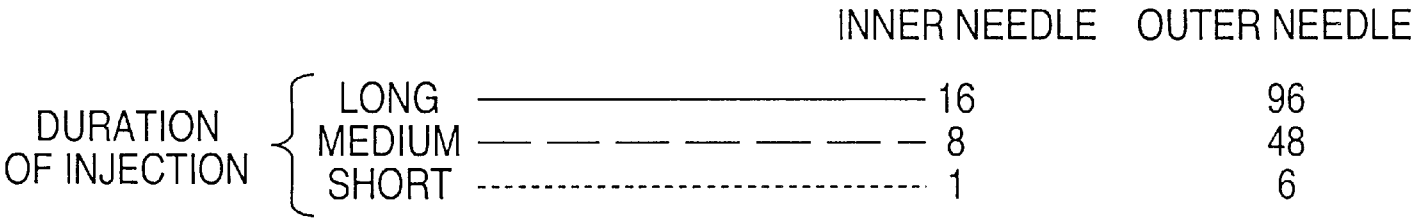

The closed nozzle injector of the present invention as illustrated in both the embodiments of FIGS. 1 and 2 results in several advantages. Importantly, the dual needle valve approach using both first and second needle valve control devices 12 and 14 provides independent control of two sets of spray orifices in one injector. Using a dedicated control volume and injection control valve for each needle valve element permits effective control over the duration of pilot and post fuel injection events while also providing variable rate shaping capability for optimized emissions and fuel economy. As shown in FIGS. 4*a* and 4*b*, the duration of injection can be very effectively controlled without changing injection pressure. As shown in FIG. 4*a*, with the inner needle valve and spray holes/orifices sized smaller than the outer needle valve and spray holes/orifices, very small injection quantities may be injected without changing injection pressure as required by many conventional injectors. Thus, the duration of pilot and post injections can be effectively controlled thereby precisely controlling the injection quantity while maintaining high injection pressure for effective atomization and distribution. FIG. 4*b* illustrates similar effective control using the outer needle and spray holes/orifices.

Figure 5A:
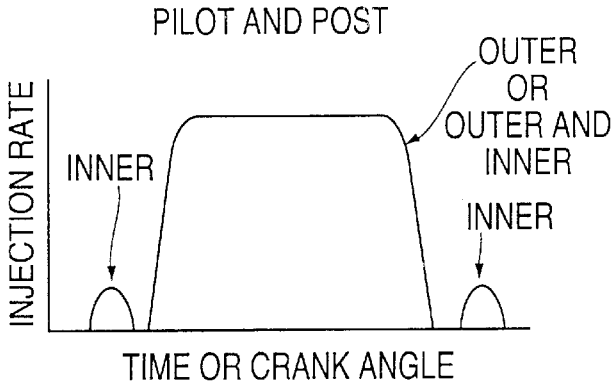
FIGS. 5*a*–5*c* are graphs showing various injection rate shapes using the injector of the present invention.
Figure 5B:
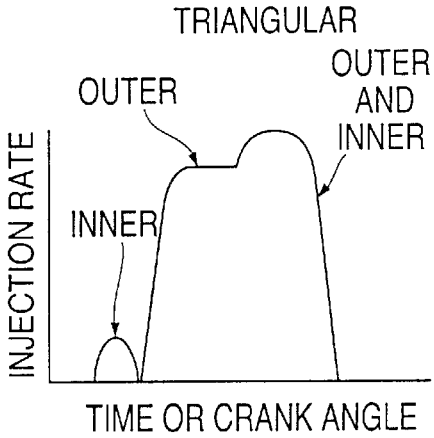
Figure 5C:
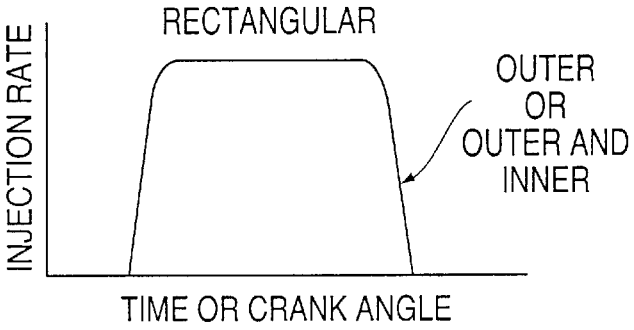
Figure 6:
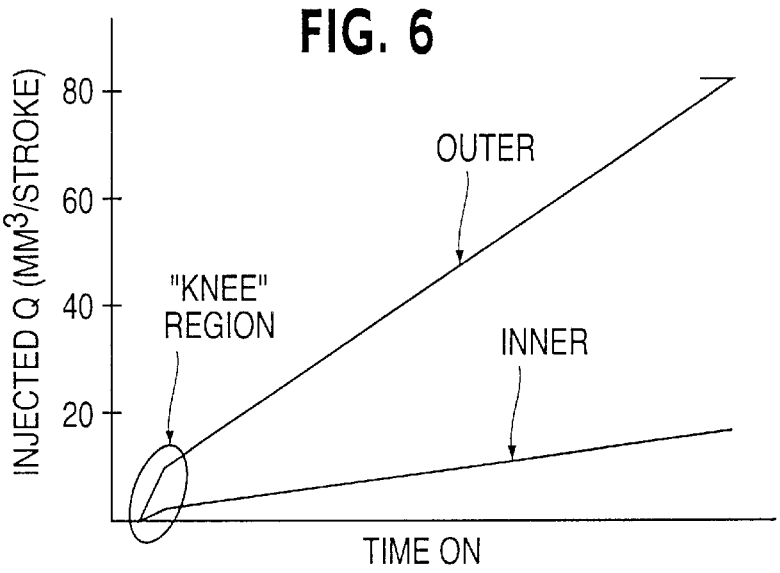
FIG. 6 is a graph showing the improvements in the injection quantity control curve using the injector of the present invention.

FIGS. 5*a*–5*c* illustrate the injection rate over time or rate shaping curves which can be achieved using the injector of the present invention. Specifically, FIG. 5*a* illustrates that the inner needle valve may be open and closed to form a pilot injection prior to the main injection event and then, if desirable, opened and closed again after the main injection event to form a post injection event. The main injection event may include only the opening of the outer needle valve or opening of both the outer and inner needle valves. FIG. 5*b* illustrates a more triangular rate shape wherein the inner needle valve is operated initially followed by the opening of only the outer needle valve while the inner needle valve is closed, followed by the reopening of the inner needle valve so that both the inner and outer needle valves are open for maximum injection before closing of both valves. FIG. 5*c* illustrates a rectangular rate shape wherein both the outer and inner needle valves or just the outer needle valve is opened to begin the injection and then closed to end the injection. Therefore, it is clear that the inner needle valve and outer needle valve can be selectively and independently operated to achieve various fuel injection characteristics. FIG. 6 further represents the ability to minimize the "knee" region in the fuel quantity curve by utilizing only the inner needle valve and injector orifices or holes. The knee is avoided at small injection quantities by using the inner needle valve and spray holes at low fuel conditions thereby avoiding the use of the outer needle valve and larger spray holes which cause the more rapid injection of a higher quantity of fuel as represented by the knee region. Other conventional injectors slow the opening of the needle valve thereby throttling the fuel across the valve seat which in turn adversely reduces injection pressure at low injected quantities resulting in poor fuel atomization and distribution and ultimately adversely affecting combustion. The present invention maintains high fuel atomization and distribution while creating a flexible approach to fuel injection control throughout engine operation. In addition, the present invention permits simple, effective removal of carbon build-up in the injector spray orifices. Carbon build-up on the spray orifices and plugging may occur in the inner set of spray orifices during extended low fueling periods when, for example, only the outer set of spray orifices are used for injection. During these operating conditions, the needle valve element may be intermittently operated to direct fuel through the inner orifices thereby periodically purging the orifices.

Industrial Applicability

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed nozzle injector assembly for injecting fuel at high pressure into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an outer end of said first needle valve element, a first control volume charge circuit for supplying fuel from said fuel transfer circuit to said first control volume, a first drain circuit for draining fuel from said first control volume to a low pressure drain, and a first injection control valve positioned along said first drain circuit for controlling the flow of fuel through said first drain circuit to control movement of said first needle valve element between said open and said closed positions; and a second control volume positioned adjacent an outer end of said second needle valve element, a second control volume charge circuit for supplying fuel from said fuel transfer circuit to said second control volume, a second drain circuit for draining fuel from said second control volume to a low pressure drain, and a second injection control valve positioned along said second drain circuit for controlling the flow of fuel through said second drain circuit to control movement of said second needle valve element between said open and said closed positions;

wherein said first and said second injection control valves each include an actuator and a reciprocally mounted, selectively movable control valve member; and wherein said actuators for said first and said second needle valve elements are positioned adjacent one another in side-by-side relationship with respective axes of reciprocation of said control valve members positioned in parallel.

2. The closed nozzle injector of claim 1, wherein said second needle valve element is telescopingly received within a cavity formed in said first needle valve element to form a sliding fit with an inner surface of said first needle valve element.

3. The closed nozzle injector of claim 2, wherein said actuator of each valve includes a solenoid assembly.

4. The closed nozzle injector of claim 1, further including a first biasing spring for biasing said first needle valve element toward said closed position and a second biasing spring for biasing said second needle valve element toward said closed position, both of said first and said second needle valve elements extending through inner radial extents of both said first and said second biasing springs.

5. The closed nozzle injector of claim 4, wherein said first and said second biasing springs are positioned in nonoverlapping serial relationship along a longitudinal axis.

6. The closed nozzle injector of claim 4, wherein said second needle valve element is telescopingly received within a cavity formed in said first needle valve element, further including a second spring seat assembly for abutment by said second biasing spring including a transverse extension engaging said second needle valve element and extending from said second needle valve element through an aperture formed in said first needle valve element.

7. The closed nozzle injector of claim 6, wherein said aperture is elongated, said second spring seat assembly further including an annular seat connected to said transverse extension for abutment by said second biasing spring.

8. The closed nozzle injector of claim 1, wherein said first control volume is positioned along a longitudinal axis of the injector body between said injector orifices and said second control volume.

9. The closed nozzle injector of claim 1, further including a first biasing spring for biasing said first needle valve element toward said closed position and a second biasing spring for biasing said second needle valve element toward said closed position, said first control volume being positioned along a longitudinal axis of the injector body between said second control volume and said first and said second biasing springs.

10. The closed nozzle injector of claim 1, wherein said second needle valve element includes a first section, a second section and an articulated coupling connecting said first and said second sections.

11. The closed nozzle injector of claim 1, wherein said second needle valve element includes a first section, a second section and an articulated coupling connecting said first and said second sections.

12. A closed nozzle injector assembly for injecting fuel at high pressure into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element telescopingly received within a cavity formed in said first needle valve element for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an outer end of said first needle valve element, a first control volume charge circuit for supplying fuel from said fuel transfer circuit to said first control volume, and a first drain circuit for draining fuel from said first control volume to a low pressure drain;

a second control volume positioned adjacent an outer end of said second needle valve element and a spaced distance from said first control volume, a second control volume charge circuit for supplying fuel from said fuel transfer circuit to said second control volume, and a second drain circuit for draining fuel from said second control volume to a low pressured rain; and injection control valve means positioned to control the flow of fuel through said first and said second drain circuits to control movement of said first and said second needle valve elements between said open and said closed positions said injection control valve means including a solenoid actuator and a reciprocally mounted, selectively movable control valve member; and further including a first biasing spring for biasing said first needle valve element toward said closed position and a second biasing spring for biasing said second needle valve element toward said closed position, both of said first and said second needle valve elements extending through inner radial extents of both said first and said second biasing springs.

13. The closed nozzle injector of claim 12, wherein said injection control valve means includes two injection control valves including two actuator assemblies.

14. The closed nozzle injector of claim 12, wherein said first and said second biasing springs are positioned in nonoverlapping serial relationship along a longitudinal axis.

15. The closed nozzle injector of claim 12, further including a second spring seat assembly for abutment by said second biasing spring including a transverse extension engaging said second needle valve element and extending from said second needle valve element through an aperture formed in said first needle valve element.

16. The closed nozzle injector of claim 15, wherein said aperture is elongated, said second spring seat assembly further including an annular seat connected to said transverse extension for abutment by said second biasing spring.

17. The closed nozzle injector of claim 12, wherein said first control volume is positioned along a longitudinal axis of the injector body between said injector orifices and said second control volume.

18. The closed nozzle injector of claim 12, further including a first biasing spring for biasing said first needle valve element toward said closed position and a second biasing spring for biasing said second needle valve element toward said closed position, said first control volume being positioned along a longitudinal axis of the injector body between said second control volume and said first and second biasing springs.

19. A closed nozzle injector assembly for injecting fuel at high pressure into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an outer end of said first needle valve element, a first control volume charge circuit for supplying fuel from said fuel transfer circuit to said first control volume, a first drain circuit for draining fuel from said first control volume to a low pressure drain, and a first injection control valve positioned along said first drain circuit for controlling the flow of fuel through said first drain circuit to control movement of said first needle valve element between said open and said closed positions; and a second control volume positioned adjacent an outer end of said second needle valve element, a second control volume charge circuit for supplying fuel from said fuel transfer circuit to said second control volume, a second drain circuit for draining fuel from said second control volume to a low pressure drain, and a second injection control valve positioned along said second drain circuit for controlling the flow of fuel through said second drain circuit to control movement of said second needle valve element between said open and said closed positions;

further including a first biasing spring for biasing said first needle valve element toward said closed position and a second biasing spring for biasing said second needle valve element toward said closed position, both of said first and said second needle valve elements extending through inner radial extents of both said first and said second biasing springs.

20. A closed nozzle injector assembly for injecting fuel at high pressure into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element telescopingly received within a cavity formed in said first needle valve element for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an outer end of said first needle valve element, a first control volume charge circuit for supplying fuel from said fuel transfer circuit to said first control volume, and a first drain circuit for draining fuel from said first control volume to a low pressure drain;

a second control volume positioned adjacent an outer end of said second needle valve element and a spaced distance from said first control volume, a second control volume charge circuit for supplying fuel from said fuel transfer circuit to said second control volume, and a second drain circuit for draining fuel from said second control volume to a low pressure drain; and injection control valve means positioned to control the flow of fuel through said first and said second drain circuits to control movement of said first and said second needle valve elements between said open and said closed positions;

wherein said injection control valve means includes two injection control valves including two actuator assemblies, each of said two actuator assemblies including a solenoid actuator and a reciprocally mounted, selectively movable control valve member.

* * * * *